US005174264A

United States Patent [19]

Matsuoka et al.

[11] Patent Number: 5,174,264

[45] Date of Patent: Dec. 29, 1992

[54] FUEL CONTROL SYSTEM FOR ENGINE

[75] Inventors: Hideki Matsuoka; Iwao Utsumi; Isao Shibata, all of Hiroshima, Japan

[73] Assignee: Mazda Motor Corporation, Hiroshima, Japan

[21] Appl. No.: 789,277

[22] Filed: Nov. 8, 1991

[30] Foreign Application Priority Data

Nov. 27, 1990 [JP] Japan ..... 2-326700

[51] Int. Cl.[5] ..... F02D 41/18

[52] U.S. Cl. ..... 123/488; 123/492; 123/493

[58] Field of Search ..... 123/488, 492, 493

[56] References Cited

U.S. PATENT DOCUMENTS 4,616,619 10/1986 Saito et al. ..... 123/493 X
4,844,042 7/1989 Osano ..... 123/488 X
4,920,941 5/1990 Fukui et al. ..... 123/492

FOREIGN PATENT DOCUMENTS 58-25531 2/1983 Japan .

*Primary Examiner*—Tony M. Argenbright
*Attorney, Agent, or Firm*—Sixbey, Friedman, Leedom & Ferguson

[57] ABSTRACT

A fuel control system for an engine has a fuel injector which injects fuel into an intake passage of the engine. An airflow meter detects the amount of intake air of the engine. A controller controls the amount of fuel to be injected from the fuel injection means on the basis of a dulled value by dulling a present value of the output of the airflow meter so that the preceding value of the output of the airflow meter is reflected in the dulled value in a predetermined proportion. The degree of reflection of the preceding value of the output of the airflow meter in the dulled value is reduced when the relation between the value of the output of the airflow meter and the dulled value is inverted.

8 Claims, 7 Drawing Sheets

FUEL CONTROL SYSTEM FOR ENGINE

BACKGROUND OF THE INVENTION

1. Field of the Invention

This invention relates to a fuel control system for an engine, and more particularly to a fuel control system in which the amount of intake air during a transient state of operation of the engine can be detected more accurately 2. Description of the Prior Art As disclosed, for instance, in Japanese Unexamined Patent Publication No. 58(1983)-25531, there has been known a fuel control system for an engine in which a basic fuel injection amount is calculated on the basis of the engine speed and the intake air amount, and the amount of fuel to be injected from a fuel injection valve is controlled according to the dulled value of the basic fuel injection amount during acceleration and deceleration, the dulled value being obtained by subjecting the basic fuel injection amount to a dulling process which comprises calculation of a weighted average.

That the dulled value of the basic fuel injection amount is used during a transient state of operation of the engine is because the amount of intake air as detected by an airflow meter is larger than the actual value during acceleration and is smaller than the actual value during deceleration (overshoot of the detected value) and if the detected value of the amount of intake air is used to calculate the basic fuel injection amount as it is detected, the air-fuel ratio can become overlean or overrich. Thus the dulling process is generally effected by such calculation of a weighted average that the preceding detected value is reflected in the present detected value by a predetermined proportion so that the detected value approximates the actual value.

However such a dulling process gives rise to a problem that, for example during acceleration, when the detected value of the amount of intake air (the output of the airflow meter) shown by the solid line in FIG. 6 converges after overshooting, the dulled value shown by the chained line in FIG. 6 can become larger than the detected value due to delay in change of the dulled value caused by influence of the preceding detected value and can deviate from the actual value more than the detected value as shown by the hatched portion in FIG. 6. This can be attended to by changing the dulling coefficient which governs the degree of reflection of the preceding detected value in the dulled value, but this approach results in only causing the detected value to slowly converge in a manner different from that of the actual value and is not practicable.

SUMMARY OF THE INVENTION

In view of the foregoing observations and description, the primary object of the present invention is to provide a fuel control system in which even if the output of the airflow meter overshoots and deviates from the actual value, the deviation can be corrected with high accuracy and fuel can be injected in a proper amount.

In accordance with the present invention, when a predetermined condition is satisfied during transient operating condition of the engine such as acceleration or deceleration, the degree of reflection of the preceding detected value in the dulled value is reduced. For example, when the relation between the detected value and the dulled value obtained by subjecting the detected value to a dulling process with the preceding detected value (whether the former is larger or smaller) is inverted, the degree of reflection of the preceding detected value in the dulled value is reduced, or when the difference between the detected value and a second dulled value becomes larger than a predetermined value in which the preceding value of the detected value is more reflected than in said dulled value becomes larger than a predetermined value.

That is, in accordance with the present invention, there is provided a fuel control system for an engine comprising

- a fuel injection means which injects fuel into an intake passage of the engine,
- an intake air amount detecting means which detects the amount of intake air of the engine,
- a dulled value calculating means which calculates a dulled value by dulling a present value of the output of the intake air amount detecting means so that the preceding value of the output of the intake air amount detecting means is reflected in the dulled value in a predetermined proportion,
- a control means which controls the amount of fuel to be injected from the fuel injection means on the basis of the dulled value, and
- a correcting means which reduces the degree of reflection of the preceding value of the output of the intake air amount detecting means in the dulled value when a predetermined condition is satisfied during transient operating condition of the engine such as acceleration or deceleration.

DESCRIPTION OF THE PREFERRED EMBODIMENTS

Figure 1:
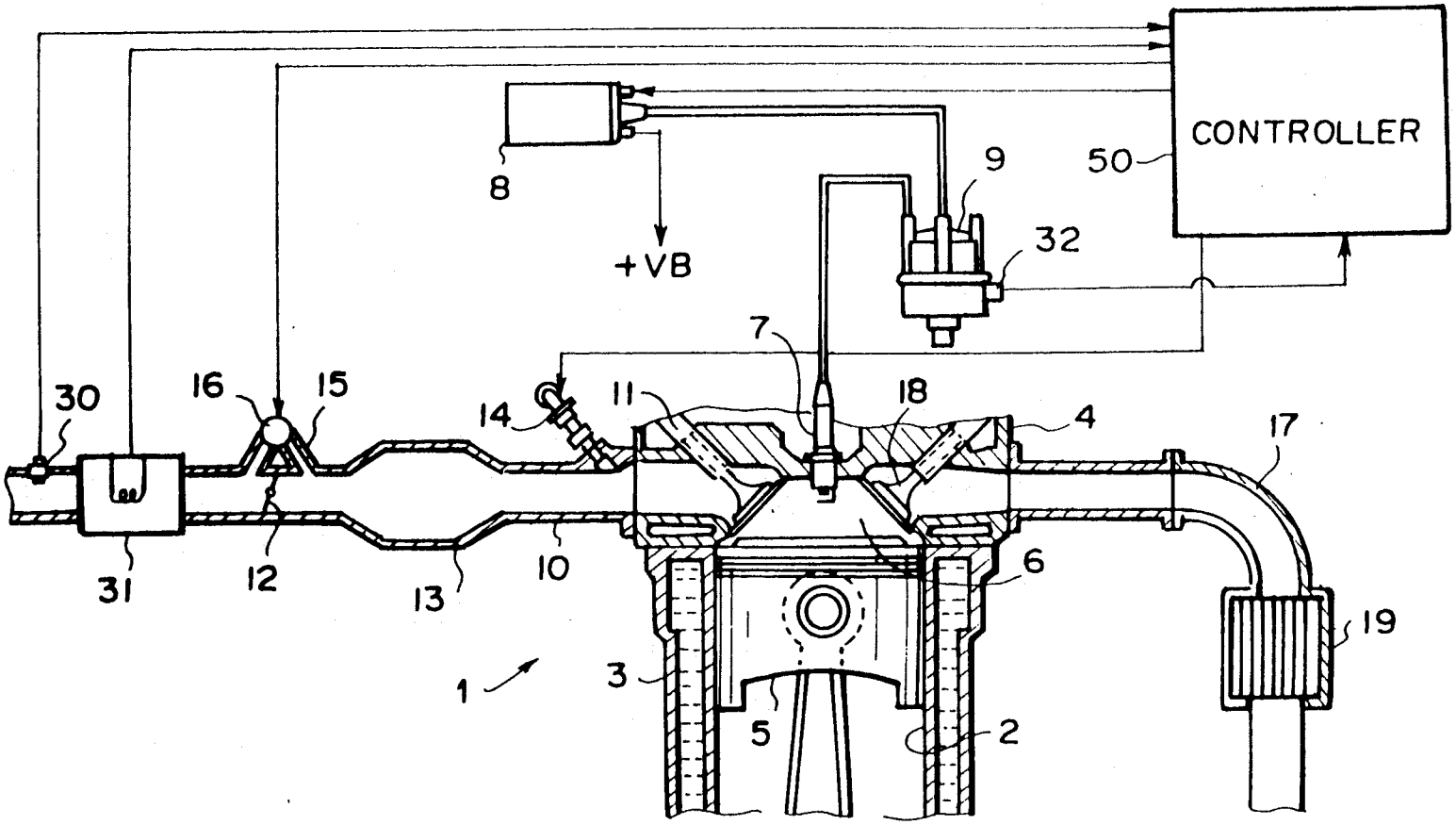
FIG. 1 is a schematic view showing an engine provided with a fuel control system in accordance with an embodiment of the present invention.

In FIG. 1, an engine 1 provided with a fuel control system in accordance with an embodiment of the present invention has a cylinder block 3 which defines a cylinder 2, a cylinder head 4 mounted on the cylinder block 3, and a piston 5 received in the cylinder 2 to define therein a combustion chamber 6. Reference numerals 7, 8 and 9 respectively denote a spark plug, an ignition coil and a distributor.

An intake passage 10 opens to the cylinder 2 by way of an intake valve 11. A throttle valve 12, a surge tank 13 and a fuel injector 14 are provided in the intake passage 10 in this order from the upstream end. Further the intake passage 10 is provided with a bypass passage 15 which bypasses the throttle valve 12. The bypass passage 15 is provided with a control valve 16 which controls the amount of air flowing through the bypass passage 15. The control valve 16 is a duty solenoid valve which is controlled according to a bypass air requirement to control the engine speed.

An exhaust passage 17 opens to the cylinder 2 by way of an exhaust valve 18. The exhaust passage 17 is provided with a catalytic convertor 19.

The spark plug 8, the injector 14 and the control valve 16 are controlled by a control unit 50 comprising a central processor unit.

In FIG. 1, reference numeral 30 denotes an intake air temperature sensor which detected the temperature of intake air upstream of the throttle valve 12, reference numeral 31 denotes a hot-wire type airflow meter which detects the amount of intake air, and reference numeral 32 denotes an engine speed sensor which detects the engine speed through the crank angle.

The output signals of the sensor 30 to 32 are input into the control unit 50.

Figure 2A:
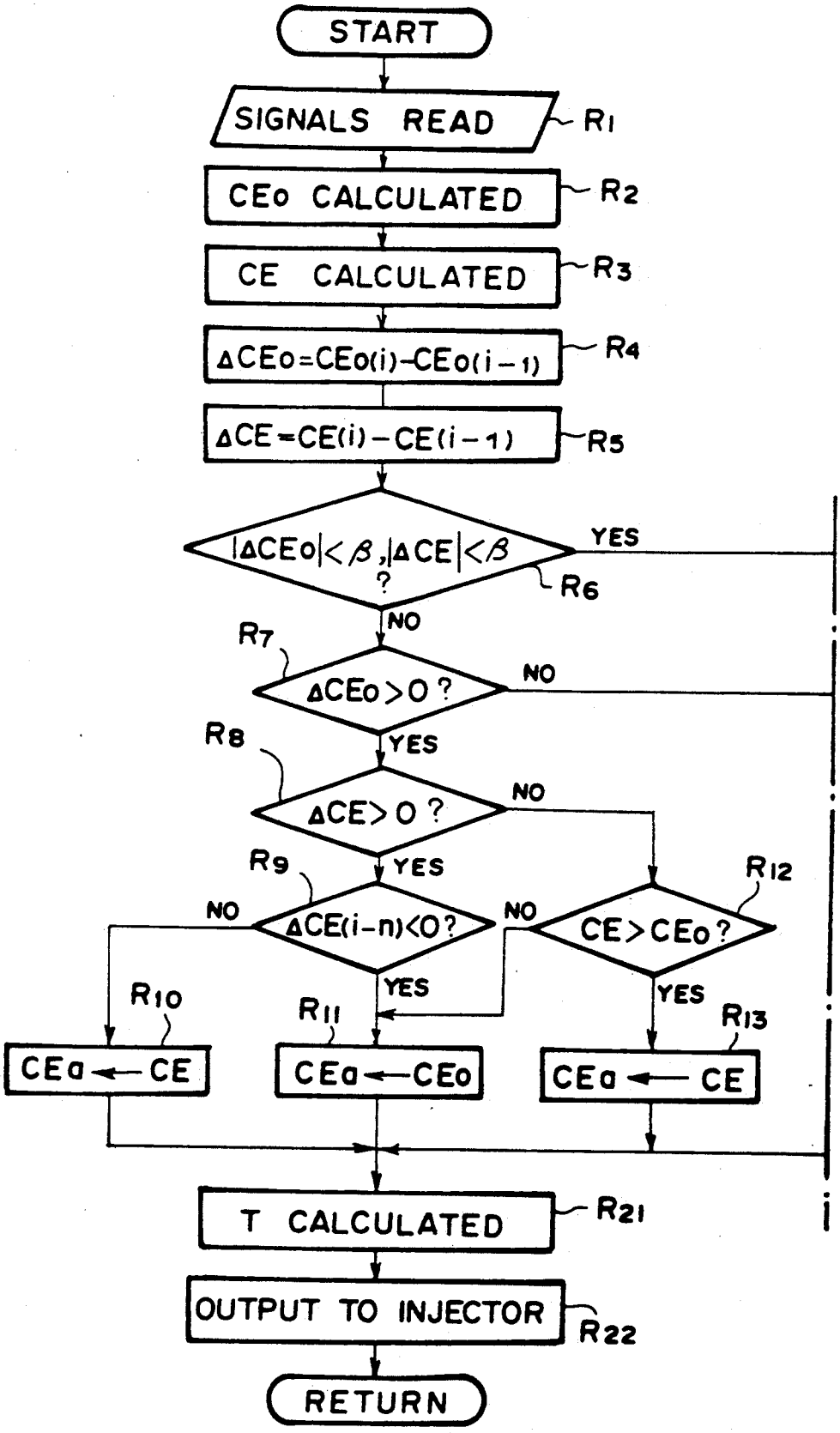
FIGS. 2, 2A and 2B are a flow chart for illustrating the operation of the control unit.
Figure 2B:
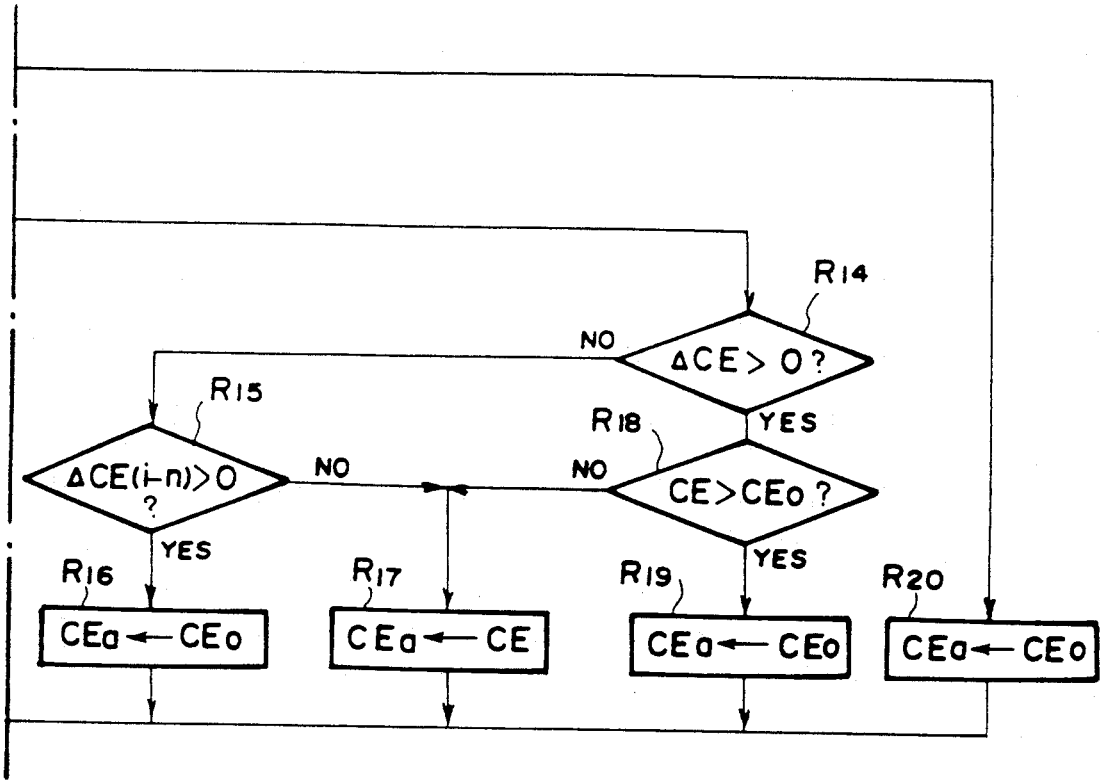
Figure 2:
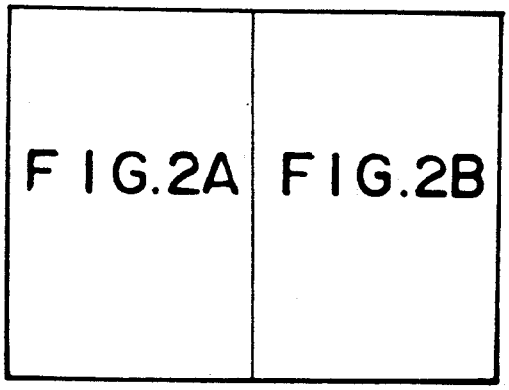

Control of the injector 14 by the control unit 50 will be described with reference to the flow chart shown in FIG. 2, hereinbelow.

Figure 3:
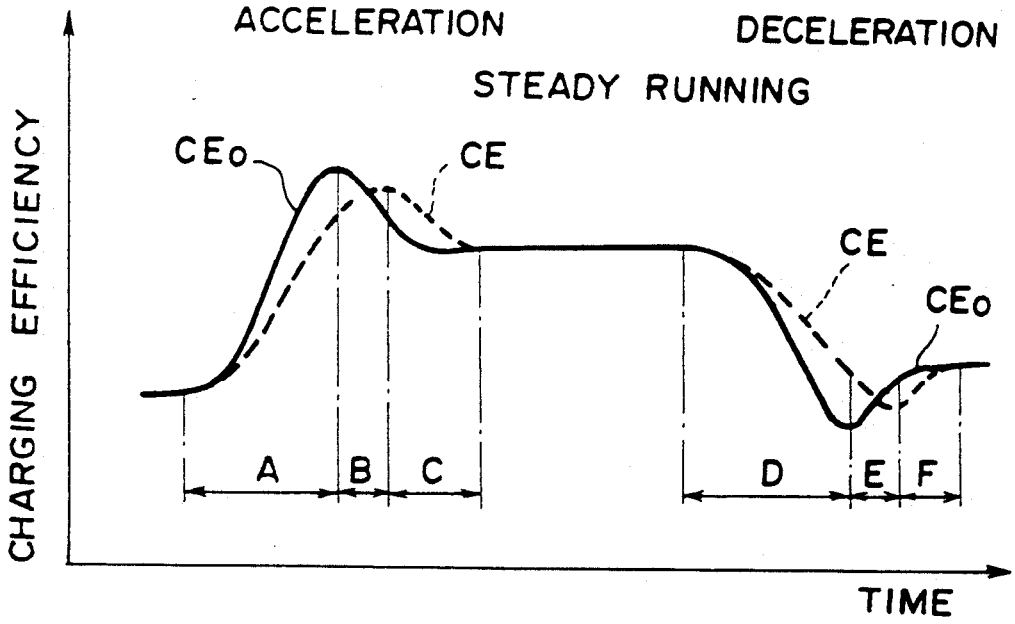
FIG. 3 is a view for illustrating the effect of the embodiment.

The control unit 50 reads the output signals of the sensors in step R1, and then calculates in step R2 the charging efficiency CEo per one revolution of the engine according to formula $CEo=(Qa/Ne)\times\alpha$ on the basis of the intake air amount Qa and the engine speed Ne read in step R1. In the above formula, $\alpha$ represents an air flow rate coefficient. In step R3, the control unit 50 calculates a dulled value CE of the charging efficiency CEo according to formula $CE=(1-K)\times CEo(i)+K\times CEo(i-1)$, wherein K represents a preset dulling coefficient. The dulling coefficient K is set so that, when the output of the airflow meter 31 overshoots during a transient state of engine operation such as acceleration or deceleration, the dulled value CE changes with a time delay to the change of the calculated charging efficiency CEo as shown in FIG. 3 and the dulled value CE is less deviates from the actual intake air amount than the calculated charging efficiency CEo. Then the control unit 50 calculates the rate of change ΔCEo of the calculated charging efficiency CEo as the difference between the present value CEo(i) and the preceding value CEo(i−1) of the calculated charging efficiency CEo, and calculates the rate of change ΔCE of the dulled value CE as the difference between the present value CE(i) and the preceding value CE(i−1) of the dulled value CE. (steps R4 and R5) Thereafter the control unit 50 determines in step R6 whether the absolute value of the rate of change ΔCEo of the calculated charging efficiency CEo is not smaller than a predetermined threshold value $\beta$ and at the same time the absolute value of the rate of change ΔCE of the dulled value CE is not smaller than the predetermined threshold value $\beta$. This is for the purpose of determining whether the engine is in a steady running state. When the answer to the question in YES, i.e., when the engine is in a steady running state, the control unit 50 proceeds to step R20 and calculates a basic fuel injection pulse CEa for the injector 14 on the basis of the calculated charging efficiency CEo according to formula $CEa=Kf\times CEo$. Thereafter the control unit 50 proceeds to step R21. On the other hand, when the answer to the question in step R6 is NO, i.e., when the engine is not in a steady running state, the control unit 50 proceeds to step R7 and determines whether the rate of change ΔCEo of the calculated charging efficiency CEo is positive. When the rate of change ΔCEo of the calculated charging efficiency CEo is positive is the period between the beginning of acceleration and the time the output of the airflow meter 31 overshoots to take a peak value or the period between the time the output of the airflow meter takes a bottom value during deceleration and the time it converges on a value, that is, the period A during acceleration and the periods E and F during deceleration as shown in FIG. 3. When it is determined in step R7 that the rate of change ΔCEo of the calculated charging efficiency CEo is positive, the control unit 50 proceeds to step R8 and determines whether the rate of change ΔCE of the dulled value CE is positive. When the answer to the question in step R8 is YES, that is, when the rate of change ΔCEo of the calculated charging efficiency CEo and the rate of change ΔCE of the dulled value CE are both positive, is the period A during acceleration or the period F during deceleration. At this time, the control unit 50 proceeds to step R9 and determines whether the rate of change of the dulled value a predetermined time before ΔCE(i−n) is negative. When ΔCE(i−n) is negative is when the engine is decelerating, i.e., the period F and when ΔCE(i−n) is positive is when the engine is accelerating, i.e., the period A. Thus when it is determined in step R9 that the ΔCE(i−n) is negative, the control unit 50 proceeds to step R21 by way of step R11, and otherwise the control unit 50 proceeds to step R21 by way of step R10. In step R11, the control unit 50 calculates the basic fuel injection pulse CEa on the basis of the calculated charging efficiency CEo according to formula $CEa=Kf\times CEo$. In step R10, the control unit 50 calculates the basic fuel injection pulse CEa on the basis of the dulled value CE according to formula $CEa=Kf\times CE$. On the other hand, when the answer to the question in step R8 is NO, that is, when the rate of change ΔCEo of the calculated charging efficiency CEo is positive and the rate of change ΔCE of the dulled value CE is negative, is the period E during deceleration. At this time, the control unit 50 proceeds to step R12. In step R12, the control unit 50 determines whether the dulled value CE is larger than the calculated charging efficiency CEo. When it is determined in step R12 that the dulled value CE is larger than the calculated charging efficiency CEo, the control unit 50 proceeds to step R13 and calculates the basic fuel injection pulse CEa on the basis of the dulled value CE according to formula $CEa=Kf\times CE$. Then the control unit 50 proceeds to step R21. When the answer to the question in step R7, i.e., when the ΔCEo is negative, is the periods B and C during acceleration or the period D during deceleration. At this time, the control unit 50 proceeds to step R14 and determines whether the rate of change ΔCE of the dulled value CE is positive. When the rate of change ΔCE of the dulled value CE is not positive, that is, when ΔCEo and ΔCE are both negative is the periods C and D. At this time, the control unit 50 proceeds to step R15 and determines whether the rate of change of the dulled value a predetermined time before ΔCE(i−n) is positive in order to determine whether the engine is accelerating or decelerating. When it is determined that ΔCE(i−n) is positive, the control unit 50 determines that the engine is accelerating (the period C in FIG. 5), the control unit 50 proceeds to step R16 and calculates the basic fuel injection pulse CEa on the basis of the calculated charging efficiency CEo according to formula $CEa=Kf\times CEo$. Thereafter the control unit 50 proceeds to step R21. When it is in step R15 determined that ΔCE(i−n) is not positive, the control unit 50 proceeds to step R17 and calculates the basic fuel injection pulse CEa on the basis of the dulled value CE according to formula CEa=Kf×CE. Then the control unit 50 proceeds to step R21. On the other hand, when it is determined in step R14 that the rate of change ΔCE of the dulled value CE is positive, that is, when ΔCEo is negative and ΔCE is positive, which is the case in the period B in FIG. 5, the control unit 50 proceeds to step R 18. In step R18, the control unit 50 determines whether the dulled value CE is larger than the calculated charging efficiency CEo. When it is determined that the dulled value CE is larger than the calculated charging efficiency CEo, the control unit 50 proceeds to step R19 and calculates the basic fuel injection pulse CEa on the basis of the calculated charging efficiency CEo according to formula CEa=Kf×CEo. Thereafter the control unit 50 proceeds to step R21, On the other hand, when the answer to the question in step R18 is NO, the control unit 50 proceeds to step R17. In step R21, the control unit 50 calculates a final fuel injection pulse T on the basis of the basic fuel injection pulse T according to formula T=CEax(1+Ctotal)+Tv, wherein Ctotal represents a correction amount which is separately obtained and Tv represents a preset ineffective injection time. Then the control unit 50 outputs the final fuel injection pulse to the injector 14 to cause it inject fuel. (step R22)

In the flow chart described above, the control unit 50 calculates in step R3 the dulled value by reflecting a predetermined proportion of the preceding output of the airflow meter 31 in the present output of the same, control the injector 14 on the basis of the dulled value, and reduces, in steps R10, R13, R17, R21 and R22, the proportion by which the preceding output of the airflow meter 31 is reflected in the present output of the same when the relation between the detected value and the dulled value (whether the former is larger or the former is smaller) is inverted.

That is, in the embodiment described above, during acceleration or deceleration, the fuel injection amount is controlled on the basis of the dulled value CE obtained by dulling the calculated charging efficiency CEo which directly corresponds to the output of the airflow meter 31, and when the relation between the calculated charging efficiency CEo and the dulled value CE is inverted, the fuel injection amount is controlled on the basis of the calculated charging efficiency CEo. More particularly, when the relation between the calculated charging efficiency CEo and the dulled value CE is inverted, the dulling coefficient K which governs the degree of reflection of the preceding detected value in the dulled value CE is nullified. Since when the output of the airflow meter 31 overshoots and deviates from the actual amount of intake air, the fuel injection amount is controlled on the basis of the dulled value CE which has been corrected to reduce the deviation from the actual amount of intake air, the influence of the overshoot of the airflow meter 31 on the air-fuel ratio can be minimized. When the output of the airflow meter 31 converges on a value after overshooting, the relation between the calculated charging efficiency CEo which directly corresponds to the output of the airflow meter 31 and the dulled value CE is inverted and the deviation of the dulled value CE from the actual amount of the intake air becomes larger than that of the calculated charging efficiency CEo. In such a case, the fuel injection amount is controlled on the basis of the calculated charging efficiency CEo which directly corresponds to the output of the airflow meter 31, and accordingly, the air-fuel ratio can be optimally controlled even when the output of the airflow meter 31 converges on a value after overshooting.

Figure 4A:
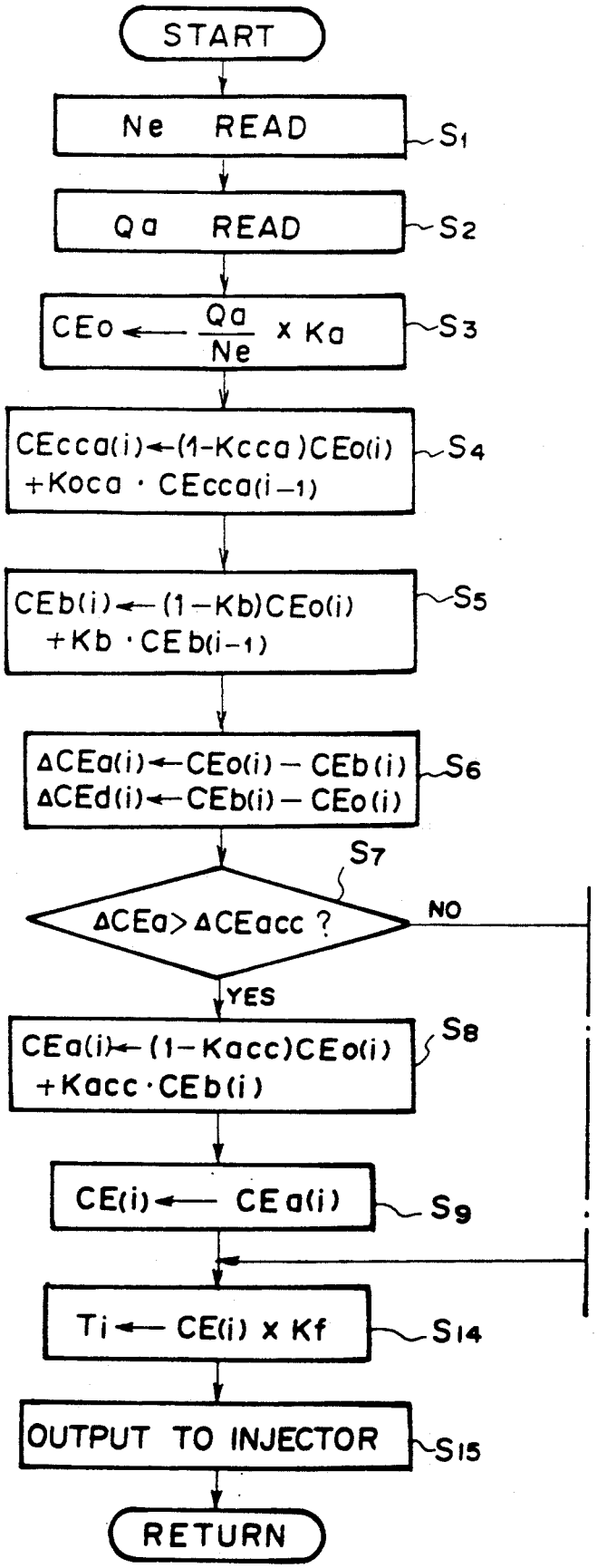
FIGS. 4, 4A and 4B are a flow chart for illustrating the operation of the control unit in another embodiment of the present invention.
Figure 4B:
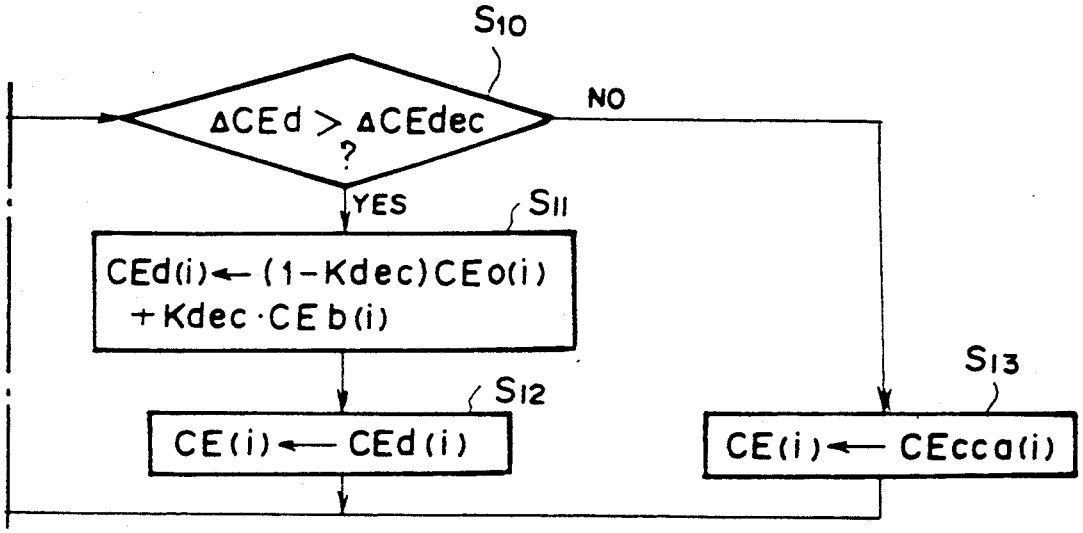
Figure 4:
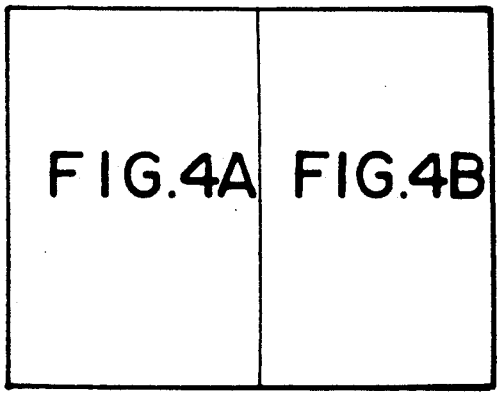

Control of the injector 14 by the control unit 50 in accordance with another embodiment of the present invention will be described with reference to the flow chart shown in FIG. 4, hereinbelow. The control unit 50 reads the engine speed Ne from the output of the engine speed sensor 32 and the amount of intake air Qa from the output of the airflow meter 31. (steps S1 and S2) Then the control unit 50 calculates in step S3 the charging efficiency CEo per one revolution of the engine according to formula CEo=(Qa/Ne)×Ka on the basis of the intake air amount Qa and the engine speed Ne. Ka represents a preset air flow rate coefficient. In step S4, the control unit 50 calculates a theoretical dulled value CEcca of the charging efficiency CEo obtained in step S4 according to formula CEcca(i)=(1−Kcca)× CEo(i)+Kcca×CEcca(i−1), wherein Kcca represents a preset theoretical dulling coefficient. The theoretical dulled value CEcca is for representing the actual change in the air intake amount which appears depending on the length and the value of the intake system while the charging efficiency CEo directly corresponds to the output of the airflow meter 31. Then in step S5, the control unit 50 calculates a dulled value CEb of the charging efficiency CEo (obtained in step S3) according to the following formula.

$$CEb(i)=(1-Kb)\times CEo(i)+Kb\times CEb(i-1)$$

The dulled value CEb is for determining whether the engine is accelerating or decelerating and will be referred to as "the acceleration-deceleration determining dulled value CEb", hereinbelow. In the above formula, Kb represents a preset dulling coefficient which is for determining whether the engine is accelerating or decelerating and is larger than Kcca, and the formula is set so that the preceding value CEb(i−1) of the acceleration-deceleration determining dulled value CEb is reflected in the present value CEb(i) of the same. The acceleration-deceleration determining dulled value CEb is dulled to slowly changed to a value on which the charging efficiency CEo converges, while the charging efficiency CEo changes abruptly. Thereafter, the control unit 50 calculates, in step S6, a rate of change ΔCEa(i) of a dulled value CEa for during acceleration and a rate of change ΔCEd(i) of a dulled value CEd for during deceleration according to the following formulae.

$$\Delta CEa(i)=CEo(i)-CEb(i)$$

$$\Delta CEd(i)=CEb(i)-CEo(i)$$

Then the control un1t 50 determ1nes 1n step S7 whether ΔCEa is larger than a preset threshold value ΔCEacc for determining whether the engine is accelerating. When it is determined that the former is larger than the latter, the control unit 50 determines that the engine is accelerating and calculates in step S8 the dulled value CEa for during acceleration as an interpolation between the charging efficiency CEo and the acceleration-deceleration determining dulled value CEb according to formula CEa(i)=(1−Kacc)×CEo(i)+Kacc× CEb(i), wherein Kacc represents a preset dulling coefficient for acceleration. Then in step S9, the control unit 50 sets the dulled value CEa(i) for during acceleration as a charging efficiency CE(i) for calculating the amount of fuel to be injected and proceeds to step S14. On the other hand, when it is determined in step S7 that ΔCEa is not larger than the preset threshold value ΔCEacc, the control unit 50 determines in step S10 whether ΔCEd calculated in step S6 is larger than a preset threshold value ΔCEdec for determining whether the engine is decelerating. When it is determined that the former is larger than the latter, the control unit 50 determines that the engine is decelerating and calculates in step S11 the dulled value CEd for during acceleration as an interpolation between the charging efficiency CEo and the acceleration-deceleration determining dulled value CEb according to formula $CEd(i)=(1-Kdec)\times CEo(i)+Kdec\times CEb(i)$, wherein Kdec represents a preset dulling coefficient for deceleration. Then in step S12, the control unit 50 sets the dulled value CEd(i) for during acceleration as a charging efficiency CE(i) for calculating the amount of fuel to be injected and proceeds to step S14. On the other hand, when it is determined that ΔCEd is not larger than the preset threshold value ΔCEdec, that is, when the engine is neither accelerating nor decelerating, the control unit 50 determines that the engine is in a steady running state and proceeds to step S13. The control unit 50 sets, in step S13, the theoretical dulled value CEacc(i) calculated in step S4 as the charging efficiency CE(i) for calculating the amount of fuel to be injected and then proceeds to step S14. That dulling is effected during steady running state of the engine where the amount of intake air is substantially constant is to suppress influence of pulsation of the intake system on the detected value of the amount of intake air, and in such a case, theoretical dulling is effected since there is no external turbulence. In step S14, the control unit 50 calculates an injection pulse Ti for the injector 14 according to formula $Ti=CE(i)\times Kf$ on the basis of the charging efficiency CE(i) calculated in step S9, S12 or S13, wherein Kf represents a preset fuel flow rate coefficient. Then the control unit 50 outputs the injection pulse Ti to the injector 14 to cause it to inject fuel in step S15, and then returns.

In the flow chart described above, the control unit 50 calculates in step S5 the dulled value by reflecting a predetermined proportion of the preceding output of the airflow meter 31 in the present output of the same, and calculates an interpolation of the dulled value and the actual output of the airflow meter 31 in steps S8 and S11.

Figure 5:
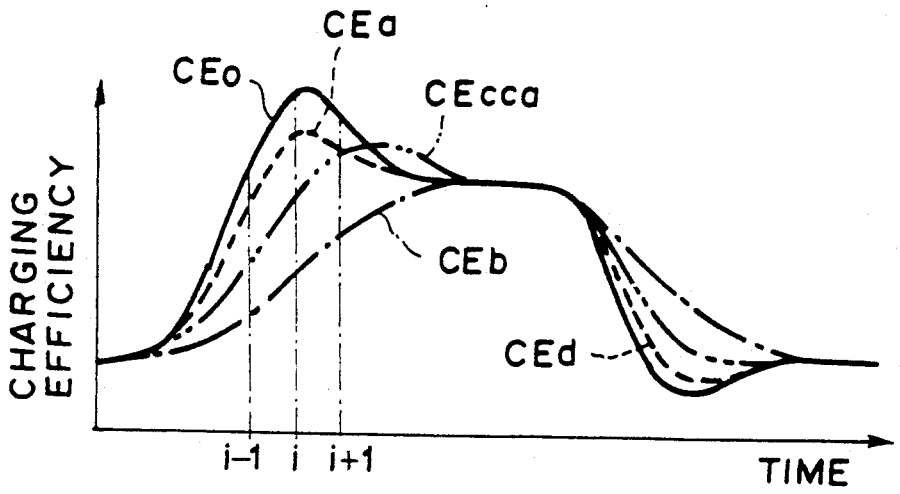
FIG. 5 is a view for illustrating the effect of the embodiment.
Figure 6:
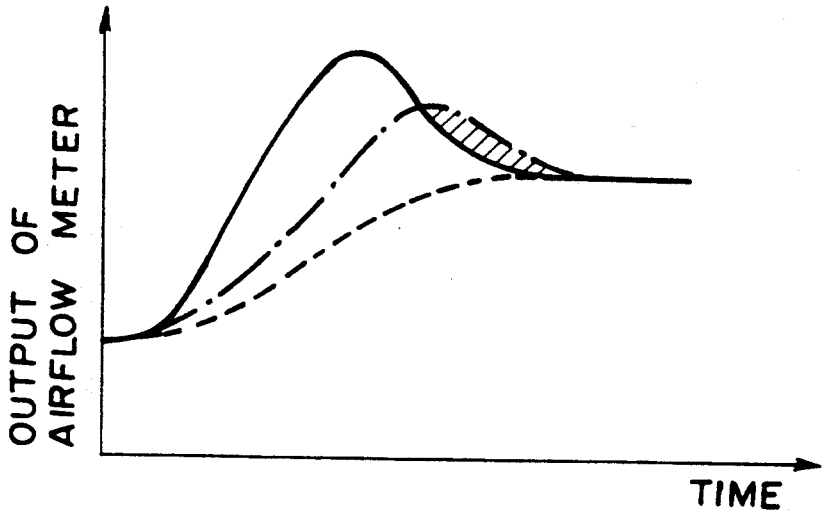
FIG.6 PRIOR ART
FIG. 6 is a view similar to FIGS. 3 and 5 but for the prior art.

FIG. 5 shows changes in the charging efficiency CEo, the theoretical dulled value CEcca, the acceleration-deceleration determining dulled value CEb, the dulled value CEa for during acceleration, and the dulled value CEd for during deceleration when the output Qa of the airflow meter 31 overshoots. The charging efficiency CEo shown by the solid line in FIG. 5 directly corresponds to the output Qa of the airflow meter 31, the theoretical dulled value CEcca shown by the double dotted chain line is dulled to slowly change with a delay to an abrupt change of the output Qa of the airflow meter 31 due to overshooting, the acceleration-deceleration determining dulled value CEb shown by the single dotted chain line is dulled to cancel the overshoot of the charging efficiency CEo and to slowly converge on a value, and the CEa for during acceleration and the CEd for during deceleration are interpolations between the charging efficiency CEo and the acceleration-deceleration determining dulled value CEb.

Accordingly, in this embodiment, during acceleration and deceleration, the amount of fuel to be injected is controlled on the basis of the dulled values CEa and CEd which are interpolations between the charging efficiency CEo and the acceleration-deceleration determining dulled value CEb, and since the dulled values CEa and CEd have been corrected to cancel the overshoot of the output of the airflow meter 31 and further corrected to approximate the actual amount of intake air by interpolation calculation, the influence of the overshoot of the output of the airflow meter on the air-fuel ratio can be minimized. Further the dulled value CEa and CEd converge in a manner similar to that of the charging efficiency CEo and converge in an optimal manner due to influence of the acceleration-deceleration determining dulled value CEb which is corrected to slowly converge on a value.

In the above flow chart, steps S6 and the steps thereafter may be performed on the basis of the theoretical dulled value CEcca instead of the acceleration-deceleration determining dulled value CEb.

What is claimed is:

1. A fuel control system for an engine comprising a fuel injection means which injects fuel into an intake passage of the engine, an intake air amount detecting means which detects the amount of intake air of the engine, a dulled value calculating means which calculates a dulled value by dulling a present value of the output of the intake air amount detecting means so that the preceding value of the output of the intake air amount detecting means is reflected in the dulled value in a predetermined proportion, a control means which controls the amount of fuel to be injected from the fuel injection means on the basis of the dulled value, and a correcting means which reduces the degree of reflection of the preceding value of the output of the intake air amount detecting means in the dulled value when a predetermined condition is satisfied during transient operating condition of the engine.

2. A fuel control system as defined in claim 1 in which said correcting means reduces the degree of reflection of the preceding value of the output of the intake air amount detecting means in the dulled value when the relation between the value of the output of the intake air amount detecting means and the dulled value calculated by the dulled value calculating means is inverted.

3. A fuel control system as defined in claim 1 in which said dulled value calculating means calculates a second dulled value in which the present value of the output of the intake air amount detecting means is less reflected than in said dulled value, and said correcting means reduces the degree of reflection of the preceding value of the output of the intake air amount detecting means in said dulled value when the difference between the output of the intake air amount detecting means and the second dulled value becomes larger than a predetermined value.

4. A fuel control system as defined in claim 1 in which said correcting means reduces the degree of reflection of the preceding value of the output of the intake air amount detecting means in said dulled value by converting said dulled value into an interpolation value between said dulled value and the output of the intake air amount detecting means.

5. A fuel control system as defined in claim 1 in which said intake air amount detecting means comprises a hot-wire type airflow meter.

6. A fuel control system as defined in claim 1 in which said dulled value is a weighted average of the present value of the output of the intake air amount detecting means and the preceding value of the same calculated with a predetermined weighting.

7. A fuel control system as defined in claim 1 in which the output of the airflow meter is expressed in the term of a charging efficiency.

8. A fuel control system for an engine comprising a fuel injection means which injects fuel into an intake passage of the engine, an intake air amount detecting means which detects the amount of intake air of the engine, a dulled value calculating means which calculates a dulled value by dulling a present value of the output of the intake air amount detecting means so that the preceding value of the output of the intake air amount detecting means is reflected in the dulled value in a predetermined proportion, an interpolating means which calculates an interpolation value between the actual output of the intake air amount detecting means and the dulled value calculated by the dulled value calculating means, and a control means which controls the amount of fuel to be injected from the fuel injection means on the basis of the interpolation value calculated by the interpolating means.

* * * * *